US005504284A

United States Patent [19]

Lazareth et al.

[11] Patent Number: 5,504,284

[45] Date of Patent: Apr. 2, 1996

[54] DEVICE FOR MECHANICAL AND ELECTRICAL LOCKOUT OF A REMOTE CONTROL UNIT FOR A MODULAR CIRCUIT BREAKER

[75] Inventors: Michel Lazareth, Eybens; Michel Effosse, Yvetot, both of France

[73] Assignee: Merlin Gerin, France

[21] Appl. No.: 186,272

[22] Filed: Jan. 25, 1994

[30] Foreign Application Priority Data

Feb. 3, 1993 [FR] France ..... 93 01274

[51] Int. Cl.[6] ..... H01H 9/20

[52] U.S. Cl. ..... 200/50 R; 200/43.14; 200/43.16

[58] Field of Search ..... 200/50 R–50 C, 200/43.01, 43.04, 43.11, 43.14, 43.15, 43.16, 43.19, 43.22

[56] References Cited

U.S. PATENT DOCUMENTS

| | | | |
|---|---|---|---|
| 3,155,786 | 11/1964 | Stegmaier | 200/42 |
| 3,601,562 | 8/1971 | Gryctko | 200/42 R |
| 3,649,784 | 3/1972 | Middendorf et al. | 200/42 T |
| 4,032,732 | 6/1977 | Homberg et al. | 200/50 A |
| 4,677,261 | 6/1987 | Nourry | 200/43.15 |
| 5,113,043 | 5/1992 | Morris | 200/43.01 |

FOREIGN PATENT DOCUMENTS

| | | | |
|---|---|---|---|
| 0174246 | 3/1986 | European Pat. Off. | H01H 9/28 |
| 2378345 | 8/1978 | France | H01H 71/50 |
| 3711138 | 10/1988 | Germany | H01H 71/70 |
| 9200930 | 3/1992 | Germany | H01H 9/28 |

*Primary Examiner*—Kristine L. Kincaid
*Assistant Examiner*—Michael A. Friedhofer
*Attorney, Agent, or Firm*—Parkhurst, Wendel & Rossi

[57] ABSTRACT

The invention relates to a device for both mechanical and electrical lockout of a remote control unit for a modular circuit breaker. This device includes a retractable ring pivoting around a spindle and provided with a locking nose arranged to cooperate with a stop pin located on the circumference of a drum rotating around a spindle and bearing a manual control handle having two stable positions. The retractable ring bears in addition a rocker designed to actuate a switch fitted on the electrical supply circuit of the remote control unit. This device is advantageous in that it also enables padlocking or sealing of the retractable ring.

14 Claims, 3 Drawing Sheets

DEVICE FOR MECHANICAL AND ELECTRICAL LOCKOUT OF A REMOTE CONTROL UNIT FOR A MODULAR CIRCUIT BREAKER

BACKGROUND OF THE INVENTION

The present invention relates to a device for mechanical and electrical lockout of a remote control unit for a modular circuit breaker, this remote control unit being provided with a handle having two stable positions respectively open and closed and means for making and breaking the electrical power supply to this unit.

German Patent application DE-3,711,138A1 describes a remote control unit associated with a modular circuit breaker, the handles of the two units being rigidly coupled by means of a connecting bar. The remote control unit mechanism comprises two transmission rods fitted between a base of the handle and a cog-wheel of the speed reducer coupled to the motor. The end of one of the rods is engaged in an oblong opening of the base, which enables manual control of the circuit breaker independently from the remote control unit. The remote control unit is in addition equipped with switches coupled to the handle to supply, when applicable, a make or break signal.

On installations comprising remote control units associated to modular circuit breakers, the advantage, and even the necessity, of providing a device performing both mechanical and electrical lockout of the system has proved essential for user safety reasons.

The object of the present invention is to provide a solution to achieve this function which is both efficient, economical and easy to implement.

SUMMARY OF THE INVENTION

To achieve this objective, the device according to the invention is characterized in that it comprises a retractable ring equipped with a part for mechanical blocking of the handle when the latter is in its open position and means for actuating a switch equipping the electrical supply circuit of the remote control unit.

According to a preferred embodiment the retractable ring and the means for actuating interruption of the remote control unit supply circuit are interactive and for this purpose said retractable ring comprises a locking nose and said handle comprises a stop pin, these two components being arranged to cooperate and provide mechanical blocking of the handle in the open position, the retractable ring being raised.

According to another embodiment these means are independent.

BRIEF DESCRIPTION OF THE DRAWINGS

Other advantages and features of the present invention will become more clearly apparent from the following description of an illustrative embodiment of the invention given as a non-restrictive example only and represented in the different phases of its operation by the accompanying drawings in which.

DETAILED DESCRIPTION OF THE PREFERRED EMBODIMENT

Figure 1:
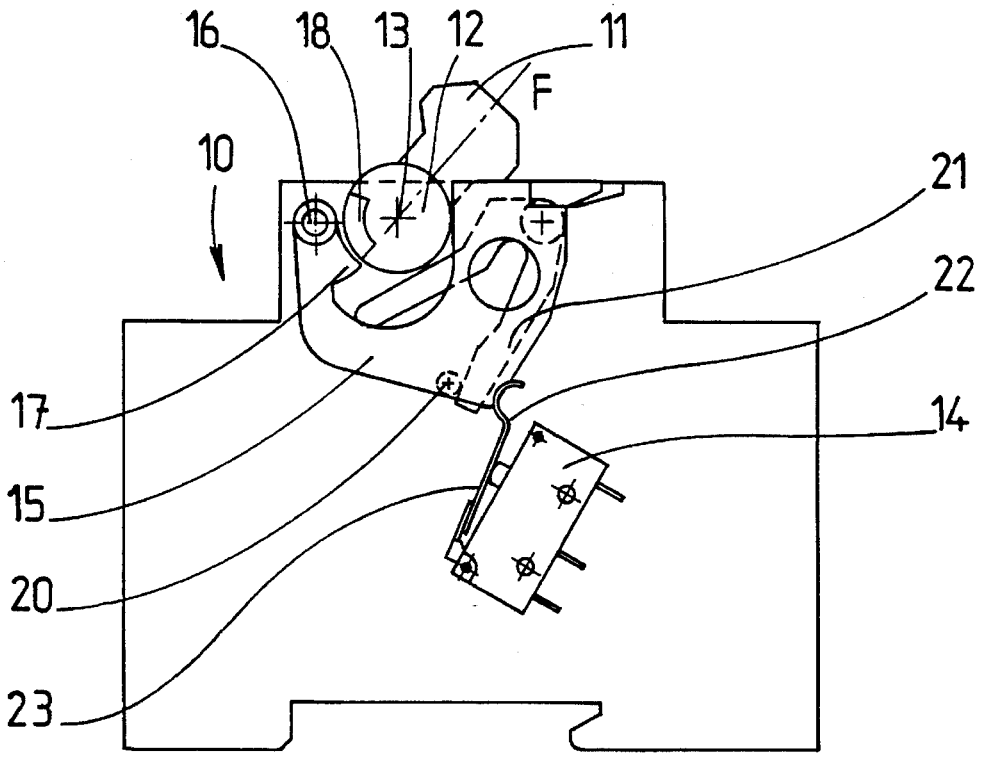
FIG. 1 schematically represents the device equipping a remote control unit, the handle of this unit being in the closed position.
Figure 2:
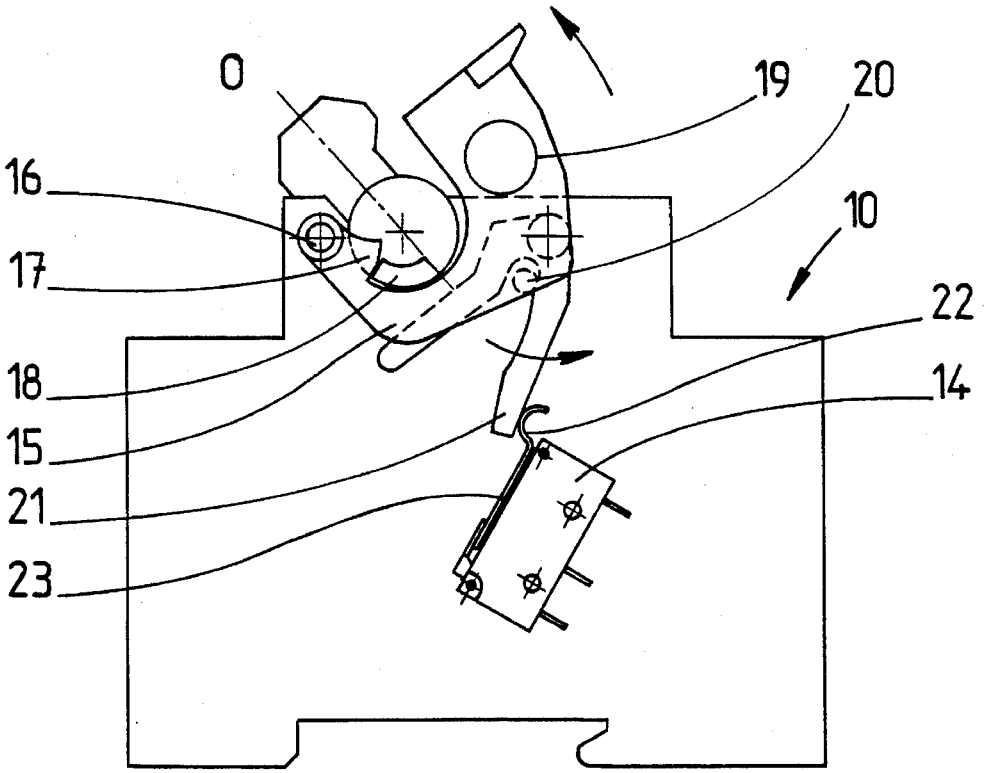
FIG. 2 represents a similar view to that of FIG. 1, in which the handle is represented in its open position.

With reference to FIGS. 1 and 2, a first embodiment of the mechanical and electrical lockout device enables mechanical blocking of a handle of the remote control unit and interruption of its electrical power supply. A remote control unit 10, represented schematically by the profile of its housing, comprises a manual closing and tripping handle 11 with two stable positions, i.e. a closed position F represented by FIG. 1 and an open position O represented by FIG. 2. This handle is securedly united to a drum 12 rotating around a fixed spindle 13. The remote control unit is in addition equipped with a switch 14 equipping its electrical supply circuit (not represented).

The mechanical and electrical lockout device proper essentially comprises a retractable ring 15 which is in its retracted position when the handle is in the closed position F (see FIG. 1) and in its raised position when the handle is in the open position O (see FIG. 2). This ring can pivot around a fixed spindle 16. It comprises a locking nose 17 arranged to cooperate with a stop pin 18 located transversely on the circumference of the drum 12 bearing the handle. When the ring is in the retracted position, the handle can be moved freely from one of its two stable positions to the other. When the latter is in the closed position it is impossible to move the ring 15, because the locking nose 17 is blocked by the pin 18. When the handle is in the open position, it is on the other hand possible to lift the retractable ring 15, which has the effect of moving the locking nose 17 behind the pin 18, and of constituting a stop preventing movement of the handle in its closed position. In this position of the retractable ring 15, the bow of a padlock can be passed through an opening 19 arranged for this purpose in retractable ring 15 which ensures that the system comprising the remote control unit and associated circuit breaker is absolutely tamperproof.

This ring moreover bears a pin 20 whose function is to make a rocker 21, designed to actuate an arm 22 up against a pushbutton 23 of the switch 14, pivot around a fixed spindle, when the retractable ring is moved to its raised position. Due to the effect of movement of the pin 20, the rocker rocks and exerts a thrust on said pushbutton 23, which has the effect of interrupting the power supply to the remote control unit circuit.

In this embodiment, the two lockings, respectively mechanical and electrical, are linked and take place simultaneously in the course of a single operation consisting in raising the retractable ring 15.

Figure 3:
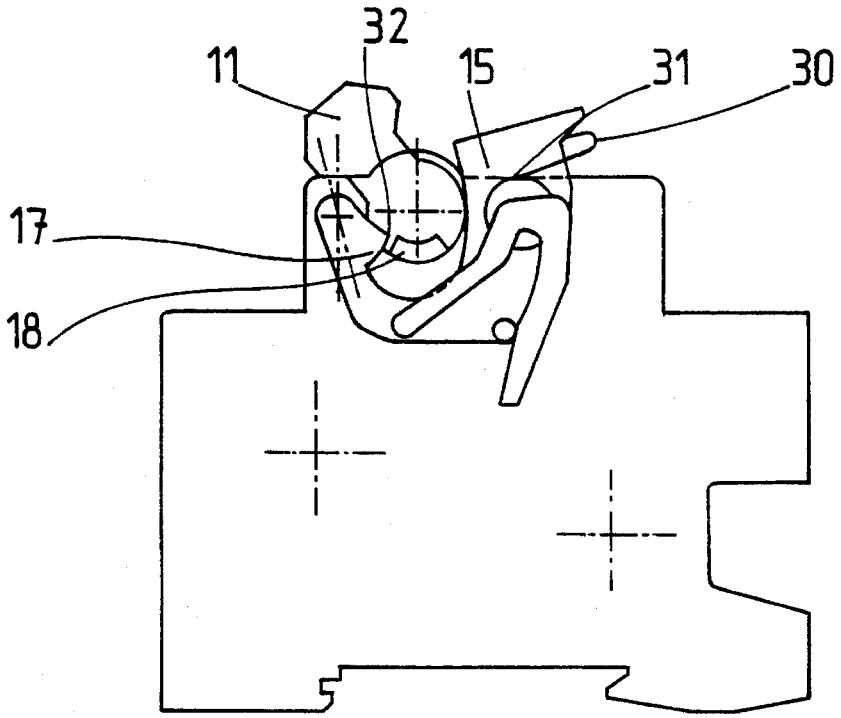
FIG. 3 represents the device of FIGS. 1 and 2 in which the retractable ring is disabled by a sealing wire.

This embodiment also enables blocking in the locked state, by means of a sealing wire replacing the padlock. FIG. 3 illustrates this use. A sealing wire 30 is passed through an opening 31 arranged through the retractable ring 15. It can be noted that, in this case, this ring is less raised than in the case of FIG. 2. Nevertheless, the locking nose 17 remains at least partially positioned behind the pin 18, in such a way that the handle 11 is locked. The condition necessary for dependable operation of the device is that the length of the edge 32 of the locking nose be sufficient for it to be able to cooperate efficiently with the pin 18.

Figure 4:
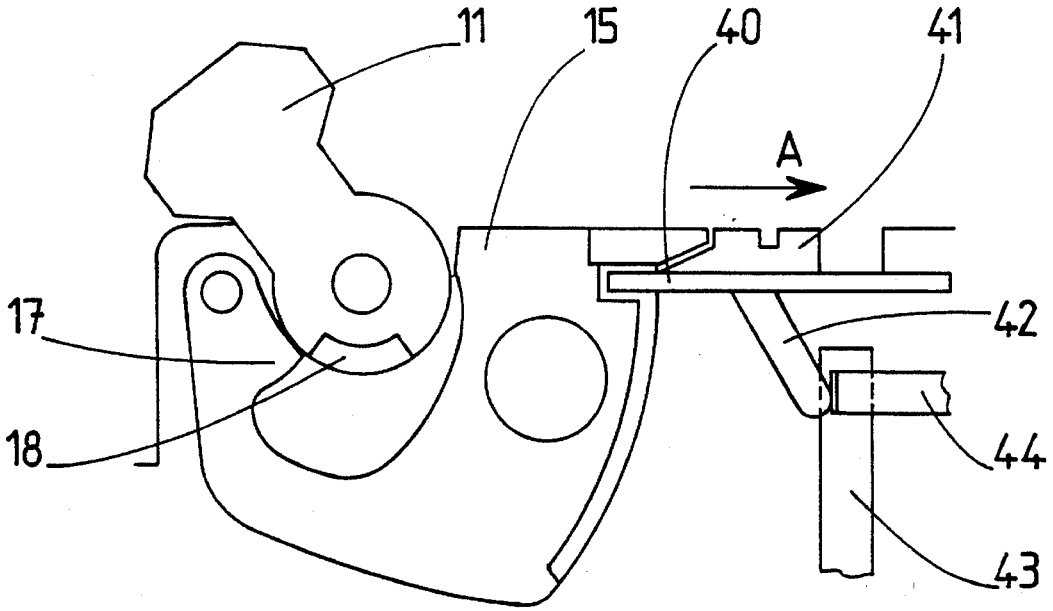
FIG. 4 represents another embodiment of the device of the invention in which the handle is free and the power supply circuit closed.

In the construction illustrated by the following figures, the two functions of mechanical lockout and electrical lockout are separated, without however ceasing to be interactive. FIG. 4 represents the device in the position where the handle 11 is not mechanically locked and where the electrical supply circuit of the remote control unit is not interrupted. The retractable ring 15 is retracted. It is held in this position by the end of a slide 40 which is associated on the one hand to a pushbutton 41 and on the other hand to an insulating tab 42 which can place itself between two conducting blades 43 and 44 when the pushbutton 41 is moved in the direction of the arrow A. In this state, the handle 11 can be actuated freely from one of its stable positions to the other, the locking nose 17 not being placed on the trajectory of the pin 18 and therefore not preventing movement of the latter and, consequently, of the handle.

Figure 5:
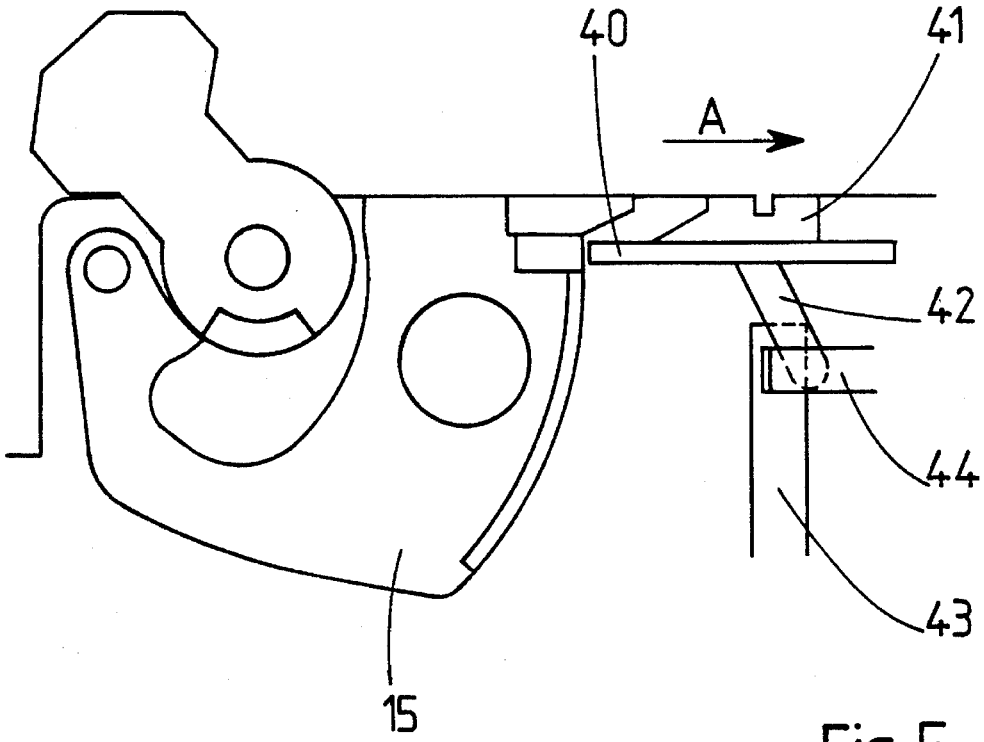
FIG. 5 represents the device of FIG. 4 in which the handle is free and the power supply circuit open.

FIG. 5 illustrates the next phase of use of this device. The pushbutton 41 has been moved in the direction of the arrow A, which has the effect of interrupting the power supply to the remote control unit by interposing the insulating tab 42 between the conducting blades 43 and 44. The end of the slide 40 is released and releases the retractable ring 15 which can thus be moved freely.

Figure 6:
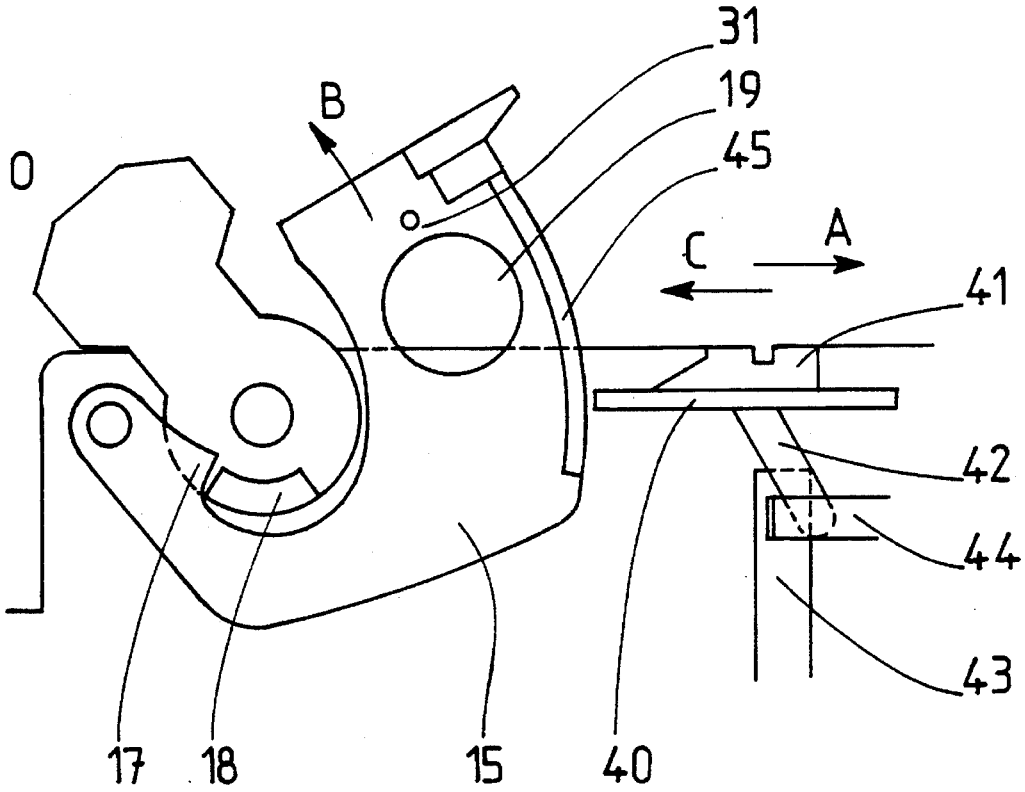
FIG. 6 represents the device of FIG. 4 in which the handle is locked in the open position and the power supply circuit is open.

This operation is illustrated by FIG. 6. It is clear that the retractable ring 15 can only be moved if the handle 11 is in its open position O. In the opposite case, the locking nose 17 is stopped by the pin 18 and prevents release of the ring, i.e. its rotation in the direction of the arrow B.

When the ring is raised, the pushbutton 41 is blocked in the position corresponding to interruption of the remote control unit supply circuit, due to the fact that movement of the slide 40 in the direction of the arrow C, opposite to the arrow A, is prevented by the front edge 45 of the retractable ring 15.

As previously, the retractable ring 15 comprises an opening 19 to enable a padlock to be fitted, and also an opening to enable a sealing wire to be passed through.

In this embodiment, prior electrical interruption authorizes a mechanical lockout which prevents unauthorized reactivation of the electrical circuit so long as the mechanical lockout is maintained. As previously, the two lockouts, mechanical and electrical, are interactive.

We claim:

1. A lockout device of a remote control unit for a circuit breaker, comprising:

a handle pivotal between open and closed positions, said handle having a stop pin extending therefrom;

locking means for locking the handle in the open position, said locking means comprising a retractable ring having a locking nose which abuts said stop pin when said retractable ring is raised, thereby blocking movement of the handle from the open position to the closed position; and actuating means for actuating a switch to interrupt power to the remote control unit.

2. The lockout device of claim 1, wherein said handle includes a drum portion and a handle portion extending therefrom, said handle being pivotal about a rotation axis of said drum portion.

3. The lockout device of claim 2, wherein said retractable ring is pivotal along a rotation axis substantially parallel to the rotation axis of the handle.

4. The lockout device of claim 2, wherein said stop pin extends from the drum portion.

5. The lockout device of claim 1, wherein the locking means and actuating means are interactive, such that upon raising of the retractable ring, said switch is actuated to interrupt the power to the remote control unit.

6. The lockout device of claim 5, wherein said actuating means comprises a rocker which pivots about a fixed spindle upon raising the retractable ring, said rocker actuating said switch.

7. The lockout device of claim 6, wherein said rocker is biased via a stud extending from the retractable ring, and said switch includes a switch button which is pushed by said rocker.

8. The lockout device of claim 1, wherein said actuating means comprises a slide member which translates along a sliding direction to interrupt power supply to the remote control unit.

9. The lockout device of claim 8, wherein the slide member includes a push button.

10. The lockout device of claim 8, wherein said switch comprises an insulating member which is positioned between two conducting blades to interrupt power supply to the remote control unit upon translation of the slide member, said insulating member extending from the slide member.

11. The lockout device of claim 8, wherein said slide member latches with said retractable ring in a retracted position thereof.

12. The lockout device of claim 11, wherein said retractable ring in the raised position prevents translation of the slide member to supply power to the remote control unit.

13. The lockout device of claim 1, wherein said retractable ring comprises an opening adapted to receive the bow of a padlock when said retractable ring is in the raised position.

14. The lockout device of claim 1, wherein said retractable ring comprises an opening adapted to receive a sealing wire when the retractable ring is in the raised position.

* * * * *